United States Patent [19]

Kobayashi et al.

[11] Patent Number: 4,833,873

[45] Date of Patent: May 30, 1989

[54] SPINDLE APPARATUS DIRECTLY DRIVEN BY ELECTRIC MOTOR

[75] Inventors: Hideaki Kobayashi, Sakura; Takeshi Obata, Narashino, both of Japan

[73] Assignee: Hitachi, Ltd., Tokyo, Japan

[21] Appl. No.: 235,531

[22] Filed: Jul. 24, 1988

[30] Foreign Application Priority Data

Aug. 24, 1987 [JP] Japan ..... 62-208091

[51] Int. Cl.[4] ..... D01H 1/244; D01H 7/04

[52] U.S. Cl. ..... 57/100; 57/129

[58] Field of Search ..... 57/100, 129, 130, 133–135; 310/10, 66, 67 R, 162, 156; 384/226–228, 239

[56] References Cited

U.S. PATENT DOCUMENTS

| | | | |
|---|---|---|---|
| 1,840,642 | 1/1932 | Stone | 57/100 X |
| 2,474,210 | 6/1949 | Abbott | 57/100 |
| 2,571,267 | 10/1951 | Ljunggren | 57/100 |
| 3,095,687 | 7/1963 | Beerli | 57/129 X |
| 3,742,268 | 6/1973 | Volkrodt | 310/156 X |
| 4,420,926 | 12/1983 | Remontet | 57/100 |
| 4,519,205 | 5/1985 | Gubler | 57/100 X |
| 4,633,664 | 1/1987 | Mueller-Storz et al. | 57/100 X |

FOREIGN PATENT DOCUMENTS 54-32864 10/1979 Japan .

*Primary Examiner*—John Petrakes

*Attorney, Agent, or Firm*—Antonelli, Terry & Wands

[57] ABSTRACT

A spindle apparatus for winding fibers has a spindle which is directly fixed to a rotor of an electric motor. One of a pair of magnetically-coupled thrusting members is fixed to a rotary part of the apparatus, while the other of the thrusting members is fixed to a stationary part of the apparatus, so that a downward thrusting force is applied to the spindle to prevent lift of the spindle during rotation thereof.

7 Claims, 4 Drawing Sheets

SPINDLE APPARATUS DIRECTLY DRIVEN BY ELECTRIC MOTOR

BACKGROUND OF THE INVENTION

1. Field of the Invention

The present invention relates to a spindle apparatus for winding fibers and, more particularly, to a spindle apparatus of the type that is directly coupled to and driven by an electric motor. Still more particularly, the invention is concerned with a fiber winding spindle apparatus directly driven by an electric motor, which is improved to prevent lifting of rotary parts and suppress vertical oscillation of the rotary parts.

2. Description of the Prior Art

Japanese Patent Examined Publication No. 54-32864 and U.S. Pat. No. 1,840,642 disclose, respectively, a spindle apparatus in which a plurality of spindles are directly driven by independent electric motors, in contrast to conventional apparatus in which the spindles are driven by a motor through tapes. The direct-drive type apparatus is advantageous in that no substantial radial load is applied to each spindle bearing as compared with the tape-driven type apparatus in which the spindle bearings are radially loaded due to tension in the driving tapes. In addition, the direct-drive type apparatus suffers from reduced fluctuation in the rotational speed, so that a high fiber-winding speed can be attained.

Current spindle apparatus for winding fibers are required to operate a high speed of from 15,000 to 30,000 rpm or higher. With the conventional tape-driven type apparatus, it is extremely difficult to attain such a high operation speed because, at such a high operation speed, the driving tapes tend to slip on the surface of the spindle wharve. In addition, a difference in the operation speed tends to be caused between different spindles, so that the spindle apparatus as a whole cannot operate satisfactorily. The tape-driven type apparatus also tends to exhibit precessions of spindles due to large radial load applied to the spindle, with the result that the bearings are worn down rapidly and heat is generated in the bearings. In consequence, the life of the spindle apparatus is shortened and the levels of noise and vibration are increased during operation of the spindle apparatus.

In the prior art direct-drive type spinde apparatus, the rotary portions of the apparatus are allowed to freely move upwards to certain heights. Therefore, the rotary portions may oscillate vertically when the rotational speed of the spindle apparatus is increased or when any unbalance of rotating mass is caused due to unbalanced winding of fibers. The sole factor which can suppress the vertical oscillation of the rotary parts is the weight of the rotary parts. Therefore, once the vertical oscillation of the rotary parts has taken place, the insert bearing, particularly the pivot bearing of the foot step in the lower portion of the apparatus, tends to be damaged, resulting in a shortened life of the spindle apparatus.

SUMMARY OF THE INVENTION

Accordingly, an object of the present invention is to provide a direct-drive type spindle apparatus which is improved to suppress the tendency for the rotary parts to oscillate vertically to thereby ensure a smooth and stable operation of the spindle apparatus.

According to the present invention, there is provided a spindle apparatus of the type that is directly driven by an electric motor, comprising: a blade rotatably supported by an insert bearing; a cylindrical wharve having an upper end fixed to the blade and a lower end which opens downward; an electric motor having a rotor fixed to a lower portion of the outer peripheral surface of the wharve and rotatable about a vertical axis and a stator carrying a stator winding and facing the rotor across an air gap. The stator is adapted to be excited by an electric current supplied to the stator winding to cause the rotor to rotate about the vertical axis. The apparatus further includes a thrust generating means including a pair of thrusting members which are magnetically coupled to each other, one of the thrusting members being fixed to a rotary part of the spindle apparatus while the other is fixed to a stationary part of the spindle apparatus so that the thrusting members magnetically interact with each other to apply a downward thrust force to the blade.

In general, a spindle apparatus employing an insert-type bearing is provided with a suitable mechanical stop which prevents the spindle from upwardly coming off the bearing. Unfortunately, however, this stop is ineffective to prevent such a small lift on the order of from 1 to 2 mm or less is encountered with the spindle apparatus of the type to which the present invention pertains.

According to the present invention, the thrust generating means generates a downward thrust force to urge the rotary parts downwards so as to fix the rotary parts with respect to the vertically immovable part, to thereby prevent undesirable lift of the rotary parts without aid of any contacting member.

Thus, then spindle apparatus of the present invention can operate in quite a stable manner over a wide range of operational speed because the lift of the rotary parts and, hence, the vertical oscillation of the rotary parts are suppressed.

The above and other objects, features and advantages of the present invention will become more clear from the following description of the preferred embodiments with reference to the accompanying drawings.

DESCRIPTION OF THE PREFERRED EMBODIMENTS

Figure 1:
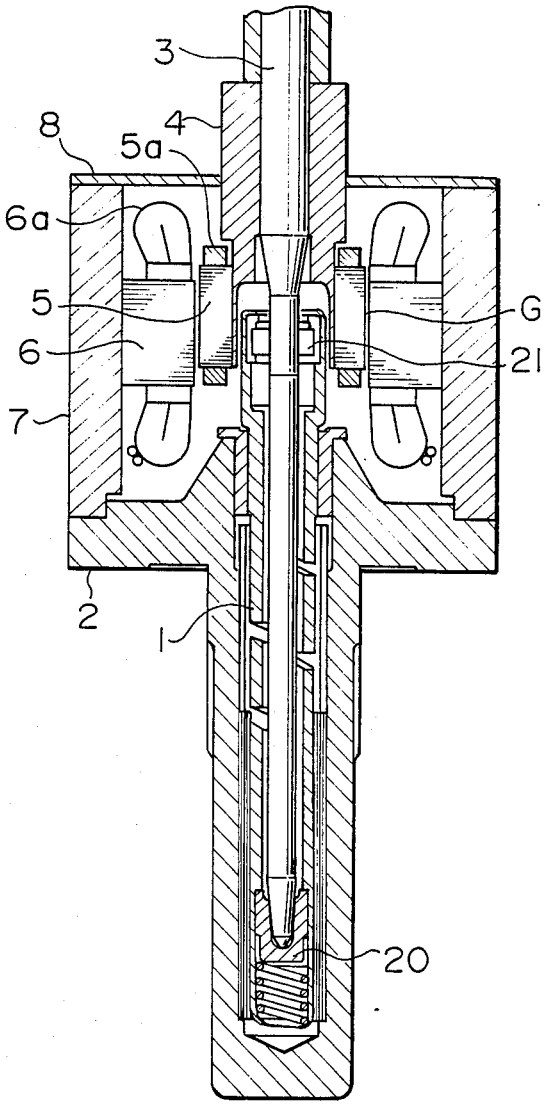
FIG. 1 is a sectional view of an embodiment of the spindle apparatus in accordance with the present invention.

A first embodiment of the direct-drive type spindle apparatus of the present invention will be described with reference to FIGS. 1 and 2. The first embodiment of the spindle apparatus has an insert bearing 1, a bolster 2 which is fixed to a stationary portion (not shown) of the apparatus and receiving the insert bearing 1, and a blade 3 rotatably supported by the insert bearing 1.

Although not shown in detail, a bobbin is adapted to be secured to an upper portion of the blade 3. The arrangement including the insert bearing 1, the bolster 2 and the blade 3 is well known, so that detailed description thereof is omitted. The insert bearing 1 is constituted by a combination of a suitable damping device and a spring device and receives the lower half portion of the blade 3 which extends vertically. More specifically, the blade 3 is supported at its lower end by a pivot bearing structure provided by a foot step 20 and at its intermediate portion by a radial bearing which is provided in an upper portion of the insert bearing 1. The foot step 20 is constituted by, for example, a spiral leaf spring provided in the bolster 2 and resiliently supports the blade 3 with suitable levels of spring constant and damping characteristic. According to this arrangement, the weight applied to the blade 3 is borne by the foot step in the insert bearing 1 while lateral oscillation of the blades 3 is suppressed by the radial bearing which is provided in the insert bearing 1.

The spindle apparatus further has a spindle wharve 4 which is fixed to the blade 3 and opens downward. An electric motor for directly driving the spindle apparatus has a rotor 5 secured to the outer peripheral surface of a thin-walled cylindrical lower end portion of the wharve 4. The rotor 5 has a laminated core and a secondary winding which is, for example, a cage-type winding provided on the core and having a lower end ring 5*a*. The electric motor also has a stator 6 which surrounds the rotor 5 with an air gap G of a predetermined size left therebetween. The stator 6 has a laminated core and a stator winding thereon. A reference numeral 7 designates a motor housing to which the stator 6 is fixed. The motor housing 7 is fixed at its lower end to the upper end of the bolster 2. A cover 8 is fixed to the upper end of the housing 7. The arrangement may be such that the cover 8 is divided into a plurality of sections which are inserted in a labyrinth-like manner into grooves formed in the wharve 4. An axial clearance is left also in such an arrangement in order to allow the rotary parts to move up and down.

This embodiment is characterized in that the electric motor is so designed and constructed that the axial center of the rotor 5 is positioned above the level of the axial center of the stator 6 so that an electromagnetic attracting force is produced so as to thrust the rotor 5 downward during operation of the motor. Thus, in this embodiment, the tendency for the rotary parts including the blade 3 to be lifted is suppressed by the downward thrust.

A detailed description will be made of the principle of this operation with specific reference to FIG. 2.

Figure 2:
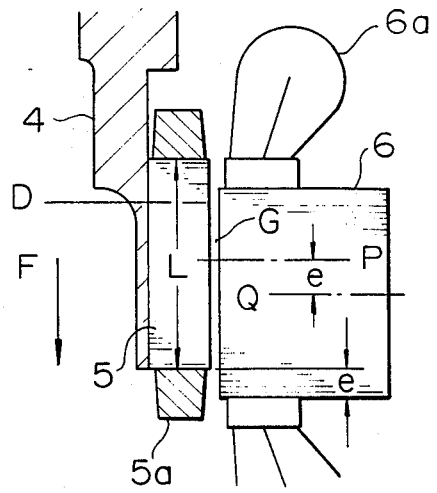
FIG. 2 is a fragmentary sectional view of the embodiment shown in FIG. 1.

Referring to FIG. 2, the axial length of the rotor 5 of the electric motor is represented by L. In this embodiment, the stator 6 of the electric motor also has the same axial length L as the rotor 5, although different axial lengths may be employed. The axial center P of the rotor 5 of the electric motor is upwardly offset from the axial center Q of the stator 6 by a distance e. The diameter of the air gap of the electric motor and the magnetic flux density in the air gap are represented by D and B, respectively. The downward electromagnetic attracting force, i.e.,the downward thrust F, produced by the interaction between the stator 6 and the rotor 5 and acting on the rotor 5, is expressed by the following formula (1):

$$F \propto D\left(\frac{L}{L-e}\right)^2 B^2 \qquad (1)$$

From this equation, it will be seen that the magnetic flux density B increases as the amount e of offset increases. Therefore, when the amount e of offset is within a small range as compared with the axial length L of the rotor 5, the downard thrust force F varies in proportion to biquadrate of the offset amount e. Conversely, when the offset amount e is determined to be too lage with respect to the axial length L, the magnetic flux density B in the air gap is increased so that exciting current in the electric motor is increased with the result that the performance of the electric motor is impaired. In this embodiment, therefore, the offset amount e is determined such that the ratio e/L ranges between 5 and 20%.

From the view point of various characteristics of the apparatus, it is considered to be advantageous to design the apparatus such that the radial bearing 21 in the upper portion of the insert bearing 1 is received in the thin-walled cylindrical lower end portion of the wharve 4 to which the rotor 5 of the electric motor is fixed.

The direct-drive type spindle apparatus of the described embodiment starts to operate when electric power is supplied to the electric motor. In the case where the electric motor is an induction motor, the power supply is commenced when a predetermined A.C. power supply is connected to the stator winding of the electric motor. The rotor 5 and, hence, the wharve 4 and the blade 3 connected to the rotor 5 start to rotate. At the same time, an electromagnetic downward thrust is produced in accordance with the amount e of offset, so that the rotor 5 is pulled downward.

As explained before, the rotary parts tend to be lifted due to various reasons such as unbalance of the masses of the rotary parts and mass unbalance which may be caused by unbalanced winding of the fiber. Such a moment, however, is effectively cancelled by the electromagnetic downward thrust force which acts on the rotor 5, so that the tendency for the rotary parts to be lifted is effectively suppressed. Thus, the described embodiment of the spindle apparatus can stably operate over a wide range of operating condition.

The axial offset of the rotor 5 with respect to the stator 6 contributes to a reduction in the axial length of the wharve 4. This in turn contributes to a reduction in the axial length of the rotary parts and serves to increase the resonance frequency of the rotary parts.

Thus, the described embodiment ensures that the direct-drive type spindle apparatus can operate highly accurately and stably over a wide range of operating condition.

Figure 3:
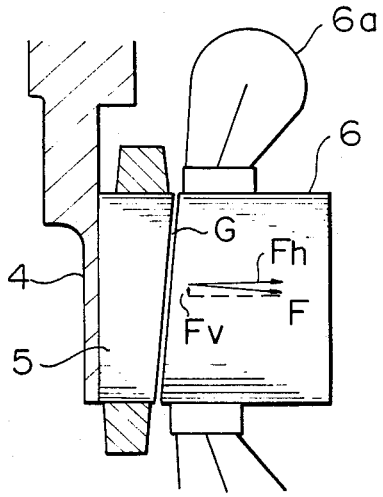
FIGS. 3, 4, 5, 6 and 7 are fragmentary sectional views of other embodiments.

Another embodiment of the invention will be described with reference to FIG. 3. In contrast to the embodiment of FIG. 1 in which the lifting tendency of the rotary parts is prevented by the axial offset of the rotor 5, the embodiment shown in FIG. 3 employs a different arrangement for generating the downward axial thrust. Namely, in this embodiment, the outer peripheral surface of the rotor 5 and the inner peripheral surface of the stator 6 are so shaped that the diameter of the air gap G formed therebetween is greater at the upper end than at the lower end. In other words, the air gap G has a frusto-conical form which diverges upwardly. In operation, the lifting of the rotary parts including the rotor 5 is suppressed by an axial component $F_v$ of the magnetic attracting force F which acts between the rotor 5 and the stator 6, thereby suppressing vertical oscillation of the rotary part. A symbol $F_h$ represents the horizontal component of the electromagnetic attracting force F.

Figure 4:
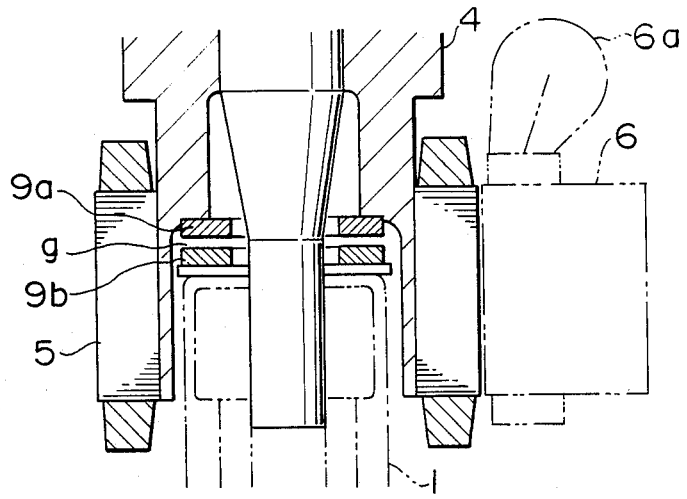

FIG. 4 shows a further embodiment in which a pair of attracting members 9*a* and 9*b* are provided on the top wall of the interior of the opening of the wharve 4 and the upper end of the insert bearing 1 so as to oppose each other across an air gap g. Thus, one 9a of the attracting members is fixed to a rotary part of the apparatus, while the other attracting member 9b is fixed to a stationary part of the apparatus. The attracting members 9a and 9b may be annular permanent magnets of opposite polarities made froma rare earth metal, or may be a combination of a permanent magnet and a member made from a ferromagnetic material. With this arrangement, it is possible to downwardly attract the rotary part towards the stationary part directly and in a non-contacting manner, so that vertical oscillation of the rotary part is effectively suppressed also in this embodiment.

Figure 5:
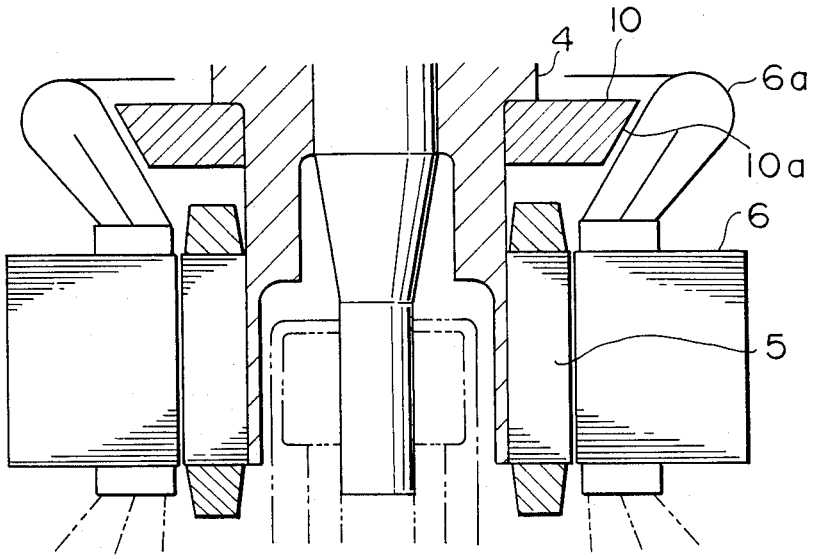

FIG. 5 shows a still further embodiment which employs a magnetic disk 10 which has a tapered outer peripheral surface 10a confronting the inner peripheral surface of the upper coil end 6a of the stator 6 and having a greater diameter at its upper end than at its lower end. The magnetic disk 10 is secured to the outer peripheral surface of the wharve 4. The coil end 6a of the stator 6 has a frusto-conical inner peripheral surface which diverges upwardly, and the magnetic disk 10 is secured to the portion of the wharve 4 above the rotor 5 of the electric motor such that an air gap of a suitable size is formed between the tapered outer peripheral surface 10a of the magnetic disk 10 and the tapered inner peripheral surface of the upper coil end 6a of the stator 6. In operation, the electric current flowing through the coil end 6a produces a magnetic flux which interacts with the magnetic disk 10. In consequence, force is generated to act on the tapered outer peripheral surface of the magnetic disk 10 in such a direction as to attract the magnetic disk 10 towards the coil end 6a. Since the surface 10a is tapered, the force acting thereon has a downward component which acts to attract the rotary parts downward. In consequence, the vertical oscillation of the rotary part is prevented also in this embodiment.

The magnetic disc 10 used in the embodiment of FIG. 5 as the thrust generating means can serve also as a balance ring which compensates for any mass unbalance of the rotary parts.

Further embodiments of the invention will be described with reference to FIGS. 6 and 7. These embodiments employ ferromagnetic hollow members 11 and 12 which are each mounted on a stationary part of the apparatus, i.e., on the upper portion of the bolster 2, in such a manner as to oppose the inner peripheral surface of an end ring 5a of the rotor 5.

Figure 6:
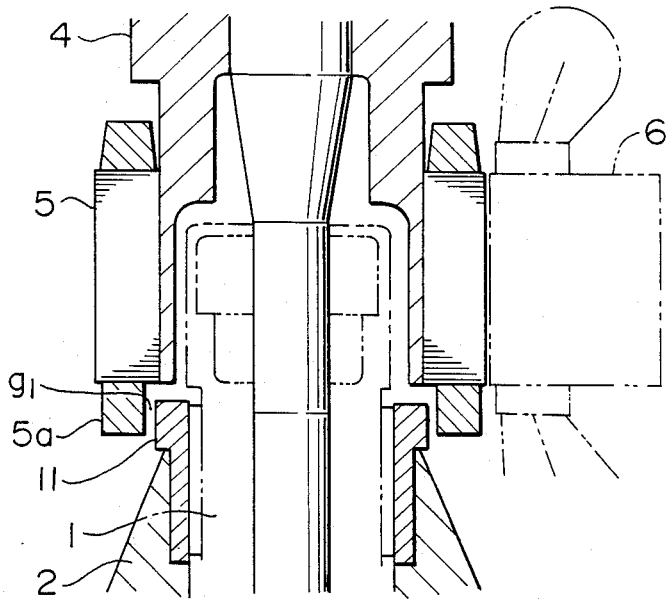

More specifically, in the embodiment shown in FIG. 6, the hollow member 11 has a cylindrical form and is sandwiched between the insert bearing 1 and an upper part of the bolster 2. The hollow member 11 has an upper end portion which is thick-walled so as to extend radially outwardly in a flange-like form. The upper portion of the outer peripheral surface of the thick-walled portion of the member 11 faces a lower portion of the inner peripheral surface of the end ring 5a with an air gap $g_1$ of a predetermined size left therebetween. Thus, the hollow member 11 is partially received in the end ring 5a with the lower portion of the member 11 exposed below the end ring 5a. In operation, the electric current flowing through the coil end 5a produces a magnetic flux which interacts with the hollow member 11 so as to attract the hollow member 11, thereby suppressing vertical oscillation of the rotary part.

Figure 7:
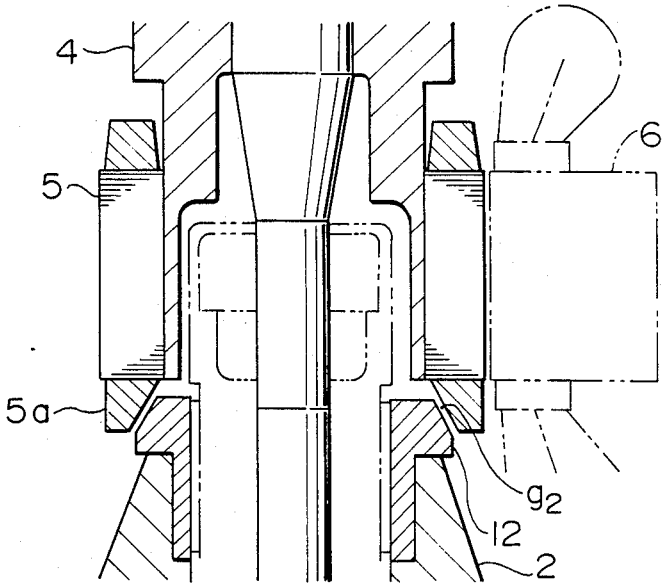

Referring now to FIG. 7, a downwardly diverging frusto-conical air gap $g_2$ is formed between the upper portion of the outer peripheral surface of the hollow member 12 and the lower portion of the inner peripheral surface of the end ring 5a. With this arrangement, a downward component of the magnetic attracting force acting between the coil end 5a and the hollow member 12 serves to effectively suppress the vertical oscillation of the rotary part. Although the hollow members 11 and 12 in the embodiments of FIGS. 6 and 7 are independent from the insert bearing 1, this is only illustrative and these hollow members may be provided integrally with the insert bearings 1 in the respective embodiments. Namely, an equivalent effect is produced when the hollow members 11 and 12 are substituted by flange-like portions formed on the insert bearings in the respective embodiments.

As will be understood from the foregoing description, according to the present invention, the undesirable vertical oscillation of rotary parts of a direct-drive spindle apparatus can be effectively prevented by the thrust generating means which can downwardly bias the rotary part without making any mechanical contact therewith. This arrangement also prevents the applications of abnormal vibratory load which may otherwise be applied to the pivot bearing structure of the foot step in the insert bearing and other parts, thereby eliminating damage and rapid wear of these parts, thus ensuring a long life of the bearing in the direct-drive type spindle apparatus of the kind described. In addition, the spindle apparatus of the invention can operate stably and smoothly by virtue of the elimination of vertical oscillation.

Although different embodiments having different constructions of thrust generating means have been described, it is to be understood that the spindle apparatus of the present invention can employ a combination of two or more of these thrust generating means. Obviously, the magnitude of the downward thrust force to be generated by the thrust generating means and characteristics of insert bearing and other parts of the apparatus can be freely selected in accordance with conditions of operation of the spindle apparatus.

What is claimed is:

1. A spindle apparatus of the type that is directly driven by an electric motor, comprising:

a blade rotatably supported by an insert bearing;

a cylindrical wharve having an upper end fixed to said blade and a lower end which opens downwards;

an electric motor having a rotor fixed to a lower portion of the outer peripheral surface of said wharve and rotatable about a vertical axis and a stator carrying a stator winding and facing said rotor across an air gap, said stator being adapted to be excited by an electric current supplied to said stator winding to cause said rotor to rotate about said vertical axis; and thrust generating means including a pair of thrusting members which are magnetically coupled to each other, one of said thrusting members being fixed to a rotary part of said spindle apparatus while the other is fixed to a stationary art of said spindle apparatus so that said thrusting members magnetically interact with each other to supply a downward thrust force to said blade.

2. A spindle apparatus according to claim 1, wherein one of said thrusting members is formed by said rotor which is so disposed that the axial center thereof is offset upwardly from the axial center of said stator which serves as said the other thrusting member, whereby said rotor is magnetically attracted downwardly by the magnetic force acting between said rotor and said stator.

3. A spindle apparatus according to claim 1, wherein at least one of said pair of thrusting members is formed by a permanent magnet and said thrusting members are arranged to oppose each other in the axial direction of said apparatus with an axial air gap left therebetween.

4. A spindle apparatus according to claim 1, wherein one of said thrusting members is formed by the upper coil end of said stator winding having an upwardly diverging inner peripheral surface, while the other of said thrusting members comprises a magnetic disk secured to said wharve and having upwardly diverging outer peripheral surface facing said inner peripheral surface of said upper coil end.

5. A spindle apparatus according to claim 1, wherein one of said thrusting members is formed by said rotor of said electric motor while the other of said thrusting members comprises said stator of said electric motor, said rotor and said stator being so arranged that an upwardly diverging frusto-conical air gap is defined therebetween.

6. A spindle apparatus according to claim 1, wherein one of said thrusting members is formed by a lower end ring of a secondary conductor of said rotor, while the other of said thrusting members comprises a ferromagnetic hollow member secured to said stationary part in such a manner as to oppose the inner peripheral surface of said lower end ring.

7. A spindle apparatus according to claim 6, wherein said hollow member comprises said insert bearing a portion of which is shaped to extend radially outward in the form like a flange.

* * * * *

UNITED STATES PATENT AND TRADEMARK OFFICE

CERTIFICATE OF CORRECTION

PATENT NO. : 4,833,873

DATED : May 30, 1989

INVENTOR(S) : KOBAYASHI, et al

It is certified that error appears in the above-identified patent and that said Letters Patent is hereby corrected as shown below:

On the title page

Please correct the filing date from:

"[22] Filed: Jul. 24, 1988" to:

--[22] Filed: Aug. 24, 1988--

Signed and Sealed this

Twenty-fourth Day of April, 1990

*Attest:*

HARRY F. MANBECK, JR.

*Attesting Officer*

*Commissioner of Patents and Trademarks*